US006114645A

United States Patent [19]

Burgess

[11] Patent Number: 6,114,645

[45] **Date of Patent: *Sep. 5, 2000**

[54] PRESSURE ACTIVATED SWITCHING DEVICE

[76] Inventor: Lester E. Burgess, Box 522, Swarthmore, Pa. 19081

[ * ] Notice: This patent is subject to a terminal disclaimer.

[21] Appl. No.: 08/979,892

[22] Filed: Nov. 26, 1997

Related U.S. Application Data

[63] Continuation-in-part of application No. 08/429,683, Apr. 27, 1995, Pat. No. 5,695,859.

[51] Int. Cl.[7] ..... H01H 1/00

[52] U.S. Cl. ..... 200/512; 200/514; 338/99; 338/113; 338/114

[58] Field of Search ..... 200/86 R, 85 R, 200/86.5, 512, 514, 511; 338/99, 114, 113

[56] References Cited

U.S. PATENT DOCUMENTS

| | | | |
|---|---|---|---|
| 2,951,817 | 9/1960 | Myers | 252/511 |
| 3,315,050 | 4/1967 | Miller | 200/61.43 |
| 3,321,592 | 5/1967 | Miller | 200/61.43 |
| 3,462,885 | 8/1969 | Miller | 49/488 |
| 3,634,334 | 1/1972 | Burgess | 252/514 |
| 3,668,337 | 6/1972 | Sinclair | 200/5 A |
| 3,693,026 | 9/1972 | Miller | 200/61.43 |
| 3,754,176 | 8/1973 | Miller | 318/266 |
| 3,821,500 | 6/1974 | Newman | 200/86 R |
| 3,855,733 | 12/1974 | Miller | 49/488 |
| 3,859,485 | 1/1975 | Blinkilde et al. | 200/85 A |
| 3,896,590 | 7/1975 | Miller | 49/488 |
| 3,960,044 | 6/1976 | Nagai et al. | 84/1.01 |
| 4,014,217 | 3/1977 | Lagasse et al. | 73/865.7 |
| 4,051,336 | 9/1977 | Miller | 200/61.43 |
| 4,115,952 | 9/1978 | French | 49/26 |
| 4,121,488 | 10/1978 | Akiyama | 84/720 |
| 4,137,116 | 1/1979 | Miller | 156/269 |
| 4,143,367 | 3/1979 | Schestag | 340/540 |
| 4,172,216 | 10/1979 | O'Shea | 200/85 R |
| 4,200,777 | 4/1980 | Miller | 200/85 A |
| 4,220,815 | 9/1980 | Gibson et al. | 178/18 |
| 4,273,974 | 6/1981 | Miller | 200/61.43 |
| 4,349,710 | 9/1982 | Miller | 200/61.43 |
| 4,360,716 | 11/1982 | Fiorella | 200/5 A |
| 4,369,344 | 1/1983 | Diamond | 200/61.43 |
| 4,396,814 | 8/1983 | Miller | 200/61.43 |
| 4,481,815 | 11/1984 | Overton | 73/865.7 |
| 4,497,989 | 2/1985 | Miller | 200/86 R |
| 4,525,606 | 6/1985 | Sado | 200/5 A |
| 4,620,072 | 10/1986 | Miller | 200/81 R |
| 4,640,137 | 2/1987 | Trull et al. | 73/865.7 |
| 4,661,664 | 4/1987 | Miller | 200/86 R |
| 4,672,153 | 6/1987 | Kikuchi | 200/514 |
| 4,677,417 | 6/1987 | Amagishi | 338/114 |
| 4,785,143 | 11/1988 | Miller | 200/61.43 |

(List continued on next page.)

FOREIGN PATENT DOCUMENTS

| | | |
|---|---|---|
| 0167341 | 1/1986 | European Pat. Off. . |
| 0293734 | 12/1988 | European Pat. Off. . |
| 1942565 | 4/1971 | Germany . |
| 2026894 | 12/1971 | Germany . |
| 2045527 | 10/1980 | United Kingdom . |
| 2107933 | 5/1983 | United Kingdom . |
| 96/34403 | 10/1996 | WIPO . |

OTHER PUBLICATIONS

"Modern Plastics Encyclopedia", (Sep. 1967, vol. 45, No. 1A, pp. 251–255) 1968.

*Primary Examiner*—Cathy F. Lam
*Attorney, Agent, or Firm*—Dilworth & Barrese

[57] ABSTRACT

A pressure actuated switching apparatus includes first and second conductive layers and a plurality of discrete spaced apart dots between the first and second conductive layers. The dots serve as a standoff for separating the conductive layers and are fabricated from an insulative, elastomeric polymer foam which can collapse under the application of compressive force applied to the apparatus to allow contact between the conductive layers with minimized dead space. Alternatively, the standoff can include strips of electrically insulative elastomeric polymer foam.

24 Claims, 4 Drawing Sheets

U.S. PATENT DOCUMENTS

| | | | |
|---|---|---|---|
| 4,801,771 | 1/1989 | Mizuguchi et al. | 200/86 R |
| 4,837,548 | 6/1989 | Lodini | 338/47 |
| 4,845,323 | 7/1989 | Beggs | 200/85 R |
| 4,876,419 | 10/1989 | Lodini | 200/86 R |
| 4,876,420 | 10/1989 | Lodini | 200/86 R |
| 4,900,497 | 2/1990 | Lodini | 264/104 |
| 4,908,483 | 3/1990 | Miller | 200/61.43 |
| 4,914,416 | 4/1990 | Kunikane | 338/114 |
| 4,920,241 | 4/1990 | Miller | 200/86 R |
| 4,951,985 | 8/1990 | Pong et al. | 293/102 |
| 4,954,673 | 9/1990 | Miller | 200/61.43 |
| 4,964,302 | 10/1990 | Grahn et al. | 73/865.7 |
| 4,965,421 | 10/1990 | Epperson | 200/512 |
| 4,972,054 | 11/1990 | Miller et al. | 200/61.43 |
| 4,977,386 | 12/1990 | Lodini | 338/114 |
| 4,994,634 | 2/1991 | Tanji et al. | 200/5 A |
| 4,996,511 | 2/1991 | Ohkawa et al. | 338/114 |
| 5,010,774 | 4/1991 | Kikuo et al. | 73/862.046 |
| 5,014,224 | 5/1991 | Hans | 338/99 |
| 5,019,797 | 5/1991 | Marstiller et al. | 338/333 |
| 5,019,950 | 5/1991 | Johnson | 200/85 R |
| 5,023,411 | 6/1991 | Miller et al. | 200/61.43 |
| 5,027,552 | 7/1991 | Miller et al. | 49/27 |
| 5,060,527 | 10/1991 | Burgess | 73/865.7 |
| 5,062,198 | 11/1991 | Sun | 29/622 |
| 5,066,835 | 11/1991 | Miller et al. | 200/61.43 |
| 5,072,079 | 12/1991 | Miller | 200/61.43 |
| 5,089,672 | 2/1992 | Miller | 200/86 R |
| 5,132,583 | 7/1992 | Chang | 252/62.9 R |
| 5,179,460 | 1/1993 | Hinata et al. | 200/512 |
| 5,260,529 | 11/1993 | Miller | 200/61.43 |
| 5,264,824 | 11/1993 | Hour | 200/85 R |
| 5,401,922 | 3/1995 | Asta | 200/5 A |
| 5,418,342 | 5/1995 | Miller | 200/61.43 |
| 5,426,293 | 6/1995 | Miller et al. | 250/221 |
| 5,431,571 | 7/1995 | Hanrahan et al. | 439/91 |
| 5,477,217 | 12/1995 | Bergan | 340/933 |
| 5,510,812 | 4/1996 | O'Mara | 345/161 |
| 5,695,859 | 12/1997 | Burgess | 428/209 |

PRESSURE ACTIVATED SWITCHING DEVICE

CROSS REFERENCE TO RELATED APPLICATIONS

This is a continuation in part of U.S. application Ser. No. 08/429,683 filed Apr. 27, 1995, which is now issued as U.S. Pat. No. 5,695,859, and which is herein incorporated by reference in its entirely.

BACKGROUND OF THE INVENTION

1. Field of the Invention

The present invention relates to a pressure actuated switching device for closing or opening an electric circuit, and particularly to a safety mat for operating and shutting down machinery in response to personnel movement onto the mat.

2. Background of the Art

Pressure actuated electrical mat switches are known in the art. Typically, such mat switches are used as floor mats in the vicinity of machinery to open or close electrical circuits.

For example, a floor mat switch which opens an electrical circuit when stepped on may be used as a safety device to shut down machinery when a person walks into an unsafe area in the vicinity of the machinery. Conversely, the floor mat switch can be used to close a circuit and thereby keep machinery operating only when the person is standing in a safe area. Alternatively, the floor mat switch may be used to sound an alarm when stepped on, or to perform some like function.

U.S. Pat. No. 4,497,989 to Miller discloses an electric mat switch having a pair of outer wear layers, a pair of inner moisture barrier layers between the outer wear layers, and a separator layer between the moisture barrier layers.

U.S. Pat. No. 4,661,664 to Miller discloses a high sensitivity mat switch which includes outer sheets, an open work spacer sheet, conductive sheets interposed between the outer sheets on opposite sides of the spacer sheet for contacting on flexure through the spacer sheet, and a compressible deflection sheet interposed between one conductive sheet and the adjacent outer sheet, the deflection sheet being resiliently compressible for protrusion through the spacer sheet to contact the conductor sheets upon movement of the outer sheets toward each other.

U.S. Pat. No. 4,845,323 to Beggs discloses a flexible tactile switch for determining the presence or absence of weight, such as a person in a bed.

U.S. Pat. No. 5,019,950 to Johnson discloses a timed bedside night light combination that turns on a bedside lamp when a person steps on a mat adjacent to the bed and turns on a timer when the person steps off of the mat. The timer turns off the lamp after a predetermined period of time.

U.S. Pat. No. 5,264,824 to Hour discloses an audio emitting tread mat system.

Also known in the art are compressible piezoresistive materials which have electrical resistance which varies in accordance with the degree of compression of the material. Such piezoresistive materials are disclosed in U.S. Pat. Nos. 5,060,527, 4,951,985, and 4,172,216, for example.

While the aforementioned mats have performed useful functions, there yet remains need of an improved safety mat which can respond not only to the presence of force, but also to the amount and direction of force applied thereto.

Also, mat switches currently being used often suffer from "dead zones". Dead zones are non-reactive areas in which an applied force does not result in switching action. For example, the peripheral area around the edge of the conventionally used mats is usually a "dead zone". It would be advantageous to reduce the dead zones in a mat switch.

SUMMARY OF THE INVENTION

A pressure actuated switching device is provided herein which includes first and second conductive layers and a plurality of discrete spaced apart dots positioned between the first and second layers. The dots serve as a standoff and are fabricated from an electrically insulative elastomeric polymer foam which can collapse under application of compressive force applied to the apparatus. The polymer foam can be open or closed cell and can be fabricated from, for example, silicone, polyurethane, polyvinyl chloride, and natural or synthetic rubber. The conductive layers can be foil or plates of metal such as aluminum, copper, or stainless steel. Alternatively the conductive layers can be an elastomerically conductive material. Optionally, a piezoresistive material may be positioned between the conductive layers, the piezoresistive layer being separated from the first and/or second conductive layers by a layer of dots.

DETAILED DESCRIPTION OF PREFERRED EMBODIMENT(S)

The terms "insulating", "conducting", "resistance", and their related forms are used herein to refer to the electrical properties of the materials described, unless otherwise indicated. The terms "top", "bottom", "above", and "below", are used relative to each other. The terms "elastomer" and "elastomeric" are used herein to refer to material that can undergo at least 10% deformation elastically. Typically, "elastomeric" materials suitable for the purposes described herein include polymeric materials such as polyurethane, plasticized polyvinyl chloride, and synthetic and natural rubbers, and the like. As used herein the term "piezoresistive" refers to a material having an electrical resistance which decreases in response to compression caused by mechanical pressure applied thereto in the direction of the current path. Such piezoresistive materials typically are resilient cellular polymer foams with conductive coatings covering the walls of the cells.

"Resistance" refers to the opposition of the material to the flow of electric current along the current path in the material and is measured in ohms. Resistance increases proportionately with the length of the current path and the specific resistance, or "resistivity" of the material, and it varies inversely to the amount of cross sectional area available to the current. The resistivity is a property of the material and may be thought of as a measure of (resistance/length)/area. More particularly, the resistance may be determined in accordance with the following formula:

$$R=(\rho L)/A \quad \text{(I)}$$

where

R=resistance in ohms

ρ=resistivity in ohm-inches

L=length in inches

A=area in square inches

The current through a circuit varies in proportion to the applied voltage and inversely with the resistance, as provided in Ohm's Law:

$$I=V/R \quad \text{(II)}$$

where

I=current in amperes

V=voltage in volts

R=resistance in ohms

Typically, the resistance of a flat conductive sheet across the plane of the sheet, i.e., from one edge to the opposite edge, is measured in units of ohms per square. For any given thickness of conductive sheet, the resistance value across the square remains the same no matter what the size of the square is. In applications where the current path is from one surface to another of the conductive sheet, i.e., in a direction perpendicular to the plane of the sheet, resistance is measured in ohms.

Figure 1:
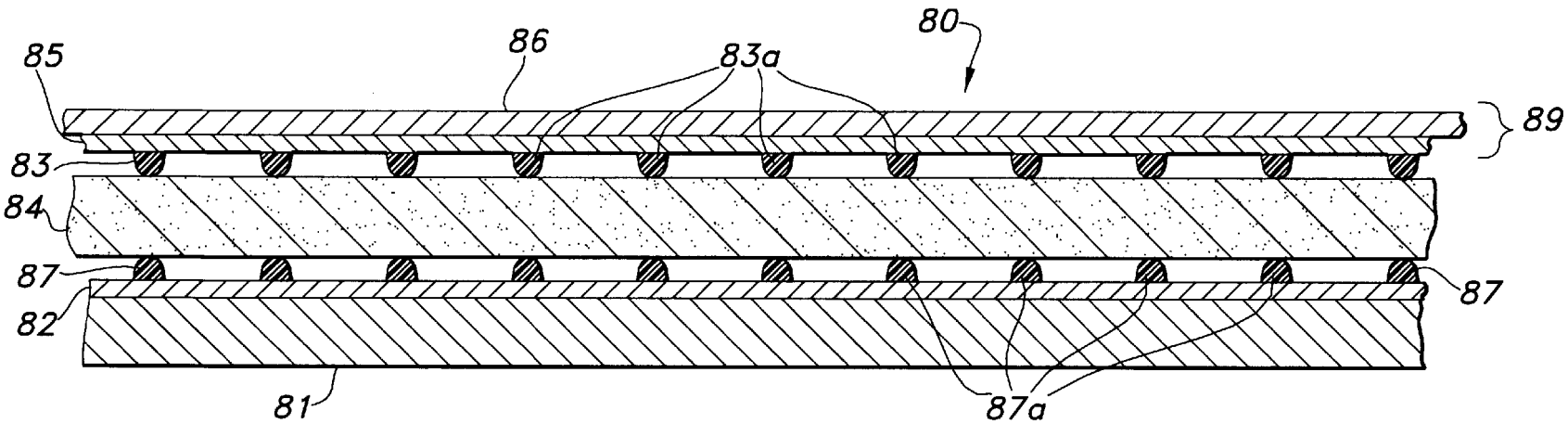
FIG. 1 is a sectional elevational view of a switching device having a dot standoff.

Referring to FIG. 1, a safety mat switching device 80 is shown with a base 81, conductive layers 82 and 85, piezoresistive layer 84, cover sheet 86, and one or two standoffs 83 and/or 87, each of which is a layer comprising a plurality of discrete, laterally spaced apart dots 83*a* and 87*a*, respectively, of insulating material.

More particularly, the base layer 81 is a sheet of any type of durable material capable of withstanding the stresses and pressures played upon the safety mat 80 under operating conditions. Base 81 can be fabricated from, for example, plastic or elastomeric materials. A preferred material for the base is a thermoplastic such as plasticized polyvinyl chloride ("PVC") sheeting, which advantageously may be heat sealed or otherwise bonded to a PVC cover sheet at the edges to achieve a hermetic sealing of the safety mat. The sheeting can be, of example, ⅛" to ¼" thick and may be embossed or ribbed. Moreover, the base 81 can alternatively be rigid or flexible to accommodate various environments or applications.

Conductive layer 82 is a metallic foil, or film, applied to the top of the base 81. Alternatively, conductive layer 82 can be a plastic sheet coated with a conductive film. This conductive coating can also be deposited on base 81 (for example, by paint applied conductive coating or electroless deposition). Conductive layer 82 can be, for example, a copper or aluminum foil, which has been adhesively bonded to base 81. The conductive layer 82 should preferably have a resistance which is less than that of the resistance of the piezoresistive material 84, described below. Typically, the conductive layer 82 has a lateral, or edge to edge resistance of from about 0.001 to about 500 ohms per square. Preferably, the resistance of the conductive layer 82 is less than half that of the piezoresistive layer 84. More preferably, the resistance of the conductive layer 82 is less than 10% that of the piezoresistive layer 84. Most preferably, the resistance of the conductive layer 82 is less than 1% that of the piezoresistive layer 84. Low relative resistance of the conductive layer 82 helps to insure that the only significant amount of resistance encountered by the current as it passes through the safety mat 80 is in that portion of the current path which is normal to the plane of the layers. Conductive layer 82 remains stationary relative to the base 81. However, another conductive layer 85, discussed below, is resiliently movable when a compressive force is applied. Upper conductive layer 85 also has low resistance relative to the piezoresistive material, which is disposed between upper conductive layer 85 and lower conductive layer 82. Thus, the measured resistance is indicative of the vertical displacement of the conductive layer 85 and the compression of the piezoresistive foam 84, which, in turn, is related to the force downwardly applied to the device. The lateral position of the downward force, i.e. whether the force is applied near the center of the device or near one or the other of the edges, does not significantly affect the measured resistance.

The piezoresistive material 84 is preferably a conductive piezoresistive foam comprising a flexible and resilient sheet of cellular polymeric material having a resistance which changes in relation to the magnitude of pressure applied to it. Typically, the piezoresistive foam layer 84 may range from 1/16" to about ½", although other thicknesses may also be used when appropriate. A conductive polymeric foam suitable for use in the present apparatus is disclosed in U.S. Pat. No. 5,060,527. Other conductive foams are disclosed in U.S. Pat. Nos. 4,951,985 and 4,172,216.

Generally, such conductive foams can be open cell foams of which the cell walls are coated with a conductive material. When a force is applied the piezoresistive foam is compressed and the overall resistance is lowered because the resistivity as well as the current path are reduced. For example, an uncompressed piezoresistive foam may have a resistance of 100,000 ohms, whereas when compressed the resistance may drop to 300 ohms.

An alternative conductive piezoresistive polymer foam, suitable for use in the present invention, is an intrinsically conductive expanded polymer (ICEP) cellular foam comprising an expanded polymer with premixed filler comprising conductive finely divided (Preferably colloidal) particles and conductive fibers. Typically, conductive cellular foams comprise a nonconductive expanded foam with a conductive coating applied throughout, on the walls of its cells. Such foams are limited to open celled foams to permit the interior cells of the foam to receive the conductive coating.

An intrinsically conductive expanded foam differs from the prior known expanded foams in that the foam matrix is itself conductive. The difficulty in fabricating an intrinsically conductive expanded foam is that the conductive filler particles, which have been premixed into the unexpanded foam, spread apart from each other and lose contact with each other as the foam expands, thereby creating an open circuit.

Surprisingly, the combination of conductive finely divided particles with conductive fibers allows the conductive filler to be premixed into the resin prior to expansion without loss of conductive ability when the resin is subsequently expanded. The conductive filler can comprise an effective amount of conductive powder combined with an effective amount of conductive fiber. By "effective amount" is meant an amount sufficient to maintain electrical conductance after expansion of the foam matrix. The conductive powder can be powdered metals such as copper, silver, nickel, gold, and the like, or powdered carbon such as carbon black and powdered graphite. The particle size of the conductive powder typically ranges from diameters of about 0.1 to about 300 microns. The conductive fibers can be metal fibers or, preferably, graphite, and typically range from about 0.1 to about 0.5 inches in length. Typically the amount, of conductive powder, ranges from about 15% to about 80% by weight of the total composition. The conductive fibers typically range from about 0.01% to about 10% by weight of the total composition.

The intrinsically conductive foam can be made according to the procedure described in Example 1 below. With respect to the Example, the silicone resin is obtainable from the Dow Corning Company under the designation SILASTIC™ S5370 silicone resin. The graphite pigment is available as Asbury Graphite A60. The carbon black pigment is available as Shawingigan Black carbon. The graphite fibers are obtainable as Hercules Magnamite Type A graphite fibers. A significant advantage of intrinsically conductive foam is that it can be a closed cell foam.

EXAMPLE 1

108 grams of silicone resin were mixed with a filler comprising 40 grams of graphite pigment, 0.4 grams of carbon black pigment, 3.0 grams of ¼" graphite fibers. After the filler was dispersed in the resin, 6.0 grams of foaming catalyst was stirred into the mixture. The mixture was cast in a mold and allowed to foam and gel to form a piezoresistive elastomeric polymeric foam having a sheet resistance of about 50K ohms/square.

The prefoamed silicone resin can be thinned with solvent, such as methylethyl ketone to reduce the viscosity. The polymer generally forms a "skin" when foamed and gelled. The skin decreases the sensitivity of the piezoresistive sheet because the skin generally has a high resistance value which is less affected by compression. Optionally, a cloth can be lined around the mold into which the prefoamed resin is cast. After the resin has been foamed and gelled, the cloth can be pulled away from the polymer, thereby removing the skin and exposing the polymer cells for greater sensitivity.

When loaded, i.e. when a mechanical force of pressure is applied thereto, the resistance of a piezoresistive foam decreases in a manner which is reproducible. That is, the same load repeatedly applied consistently gives the same values of resistance. Also, it is preferred that the cellular foam displays little or no resistance hysteresis. That is, the measured resistance of the conductive foam for a particular amount of compressive displacement is substantially the same whether the resistance is measured when the foam is being compressed or expanded.

Advantageously, the piezoresistive foam layer 14 accomplishes sparkless switching of the apparatus, which provides a greater margin of safety in environments with flammable gases or vapors present.

The cover sheet 86 is a non-conducting layer 86 which is preferably elastomeric (but can alternatively be supple but not elastomeric). The comments above with respect to the negligible resistivity of conductive layer 82 relative to that to the piezoresistive foam apply also to conductive layer 85. The conducting cover 85 can be deposited on the upper non-conducting layer 86 so as to form a cover assembly 89 with an elastomeric lower conducting surface. For example, the deposited layer 85 can also be a polymeric elastomer or coating containing filler material such as finally powdered metal or carbon to render it conducting. A conductive layer suitable for use in the present invention is disclosed in U.S. Pat. No. 5,069,527, herein incorporated by reference in its entirety.

An elastomeric conductive layer 85 can be fabricated with the conductive powder and fibers as described above with respect to the intrinsically conductive expanded polymer foam, with the exception that the polymer matrix for the conductive layer 85 need not be cellular. Preferably an elastomeric silicone is used as the matrix as set forth in Example 2.

EXAMPLE 2

A conductive filler was made from 60 grams of graphite pigment (Asbury Graphite A60), 0.4 grams carbon black (Shawingigan Black A), 5.0 grams of ¼" graphite fibers (Hercules Magnamite Type A). This filler was dispersed into 108.0 grams of silicone elastomer (SLYGARD™ 182 silicone elastomer resin). A catalyst was then added and the mixture was cast in a mold and allowed to cure.

The result was an elastomeric silicone film having a sheet resistance of about 10 ohms/square.

Alternatively, the cover assembly 89 can be flexible without being elastomeric and may comprise a sheet of metallized polymer such as aluminized MYLAR® brand polymer film, the coating of aluminum providing the conducting layer 85. As yet another alternative, the cover assembly 89 can comprise an upper layer 86 flexible polymeric resin, either elastomeric or merely flexible, and a continuous layer 85 of metal foil. Preferably the upper layer 86 is a plasticized PVC sheeting which may be heat sealed or otherwise bonded (for example by solvent welding) to a PVC base 81. The advantage to using a continuous foil layer is the greater conductivity of metallic foil as compared with polymers rendered conductive by the admixture of conductive components.

The aforementioned layers are assembled with conductive wires and individually connected, respectively, to conductive layers 82 and 85. The wires are connected to a power supply and form part of an electrical switching circuit. See, for example, FIG. 5 which is discussed below.

As a further modification the conductive layer 85 can comprise a composite of conductive elastomeric polymer bonded to a segmented metal foil or a crinkled metal foil. Slits in the segmented foil (or crinkles in the crinkled foil) permit elastomeric stretching of the conductive layer 82 while providing the high conductivity of metal across most of the conductive layer 82.

The dots 83*a* and 87*a* are respectively positioned so as to define a layer and can be applied to the conductive layers 82 and 85, or to the top and/or bottom surfaces of the piezoresistive material, for example, by depositing a fluid insulator (e.g. synthetic polymer) through a patterned screen, then allowing the pattern of dots thus formed to harden or cure. Dots 83*a* and/or 87*a* can be arrayed as a regularized pattern or, alternatively, can be randomly arrayed. When used in conjunction with a piezoresistive foam layer 84, dots 83*a* and 87*a* can optionally be fabricated from a relatively incompressible material, such as a solid, non-cellular material. For example, the material for use in fabricating the standoff dots 83*a* and 87*a* can be a polymer (e.g., methacrylate polymers, polycarbonates, polyurethane or polyolefins) dissolved in a solvent and applied to the conductive layers 82 and/or 85 as a viscous liquid. The solvent is then allowed to evaporate, thereby leaving deposited dots of polymer. Alternatively, the dots 83*a* and 87*a* can be deposited as a catalyzed resin which cures under the influence of an energy source (for example, heat, or ultra violet light). Silicones, polyurethane, rubbers, and epoxy resins are preferred materials to fabricate the dots 83*a* and 87*a*.

The dots 83*a* and 87*a* are preferably hemispherical but can be fabricated in any shape and are preferably from about 1/64" to about ¼" in height. Other smaller or larger dimensions suitable for the desired application may be chosen. The dimensions given herein are merely for exemplification of one of many suitable size ranges. The amount of deflection force necessary to switch on the device 80 depends at least in part on the height of the dots.

The edges of the mat switch 80 are preferably sealed by, for example, heat sealing. The active surface for actuation extends very close to the edge with little dead zone area.

Alternatively, the dots 83*a* and 87*a* can be fabricated from an electrically insulative elastomeric polymer foam. For example, silicone resin without conductive filler can be made into a cellular polymeric material by the addition of a foaming agent. Various other known materials and foaming methods can alternatively be used. For example, the cellular polymeric material can be foamed rubber (natural or synthetic), polyurethane or plasticized PVC. Foaming agents within such resin systems can be dissolved gasses, low boiling liquids, and chemical blowing agents that decompose or react with other components of the prefoamed polymer composition to form a gas. The gas formation within the plastic matrix forms the cells of the resulting foam.

Dead space is the area of the mat switch in which the upper and lower electrodes cannot make contact. Use of a standoff comprising a plurality of spaced apart discrete dots is advantageous in that it greatly reduces the amount of dead space in a mat switch. Use of an insulative elastomeric foam to fabricate the dots even further reduces the overall dead space by reducing the dead space around the individual dots. Typically, the density of uncompressed polymer foam can range from about 1 pound per cubic foot ("pcf") to about 20 pcf. Void space as a percentage of total volume can range from less than about 30% to more than 90%. Consequently, the foam dots collapse under the force of a weight being applied to the mat switch, and their volume is correspondingly reduced. The electrodes come into contact with each other without having to bend sharply around the dots. The greater the density (and correspondingly lesser void space) the greater the strength of the foam and its resistance to compression. Generally, a density of 2 pcf to 15 pcf is preferred.

This feature, i.e. collapsible foam dots, can advantageously be provided also to mat switches having two electrodes separated only by a standoff. For example, referring now to FIG. 2, mat switch 90 includes insulative cover sheet 91 and base 95, an upper electrode layer 92 in contact with the cover sheet 91, a lower electrode layer 94 in contact with base 95, and a standoff composed of a plurality of electrically insulative polymeric foam dots 93 disposed between the upper and lower electrode layers 92 and 94. The cover sheet 91 with electrode layer 92 can correspond in materials and methods of manufacture to the cover assembly 89 with non-conducting layer 86 and conductive layer 85, and base 95 with electrode layer 94 can correspond to base 81 with conductive layer 82. The polymer foam can be either open-celled or closed-cell foam and can be fabricated from materials described above with respect to dots 83*a* and 87*a*. Both the cover sheet 91 and base 95 are optionally fabricated from, for example, PVC, and are preferably joined around their periphery to form a water and/or air tight seal. The upper and lower electrode plates 92 and 94 are both fabricated from a sheet of electrically conductive material, for example, a metal foil, sheet, a resin coating filled with a particulate conductive material. The electrode layers 92 and 94 typically range in thickness from about 0.001 inches to about 0.030 inches, although any thickness of metal layer suitable for the purposes described herein can be used. The electrode plates 92 and 94 can optionally be fabricated from, for example, aluminum, copper, nickel stainless steel foil or conductive plastic film.

Figure 2:
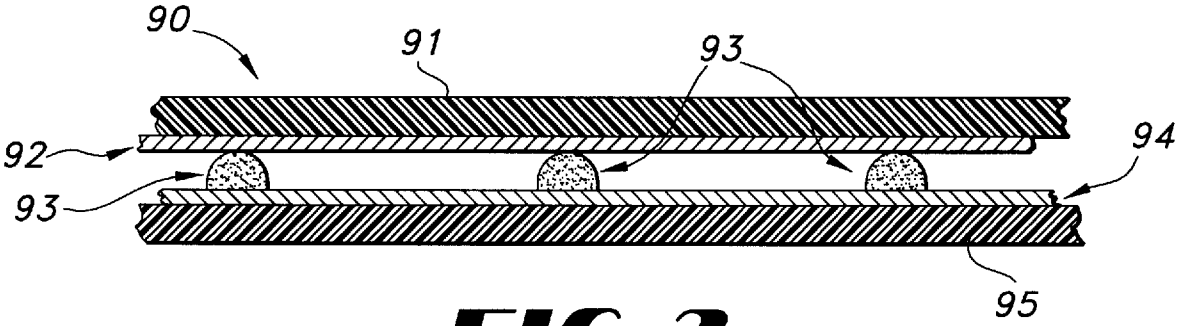
FIG. 2 is a cut away sectional side view of an of a switching device using an insulative foam dot standoff.
Figure 3:
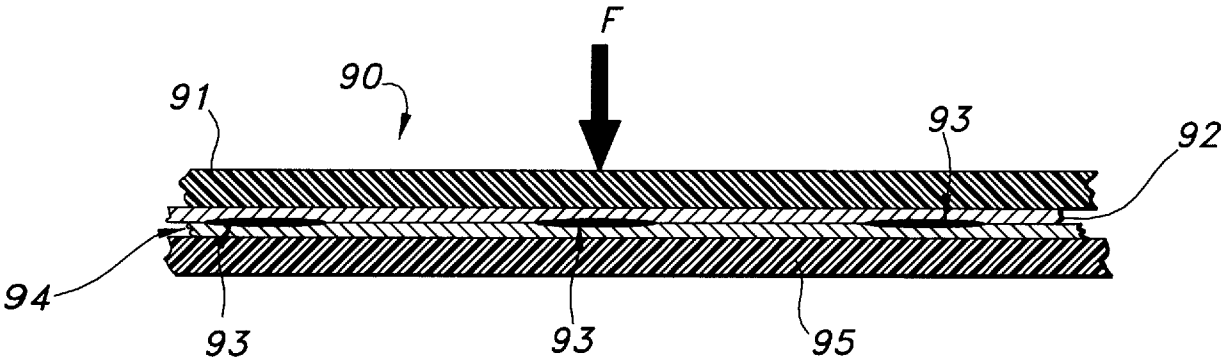
FIG. 3 is a sectional side view of the switching device of FIG. 2 under compression.

Referring now to FIG. 3, when a force F is applied to mat switch 90, the standoff dots 93 collapse to less than 50% of their original height and volume, preferably 20% of their original height and volume, more preferably less than 5% of their original height and volume. Accordingly, the upper electrode layer 92 flexes under the compression force and comes into intimate contact with the lower electrode layer 94 leaving minimal dead space around the periphery of the dots 93. When the force is removed the standoff dots resiliently return to their original configuration and the mat switch 90 returns to the position as shown in FIG. 2.

Figure 4:
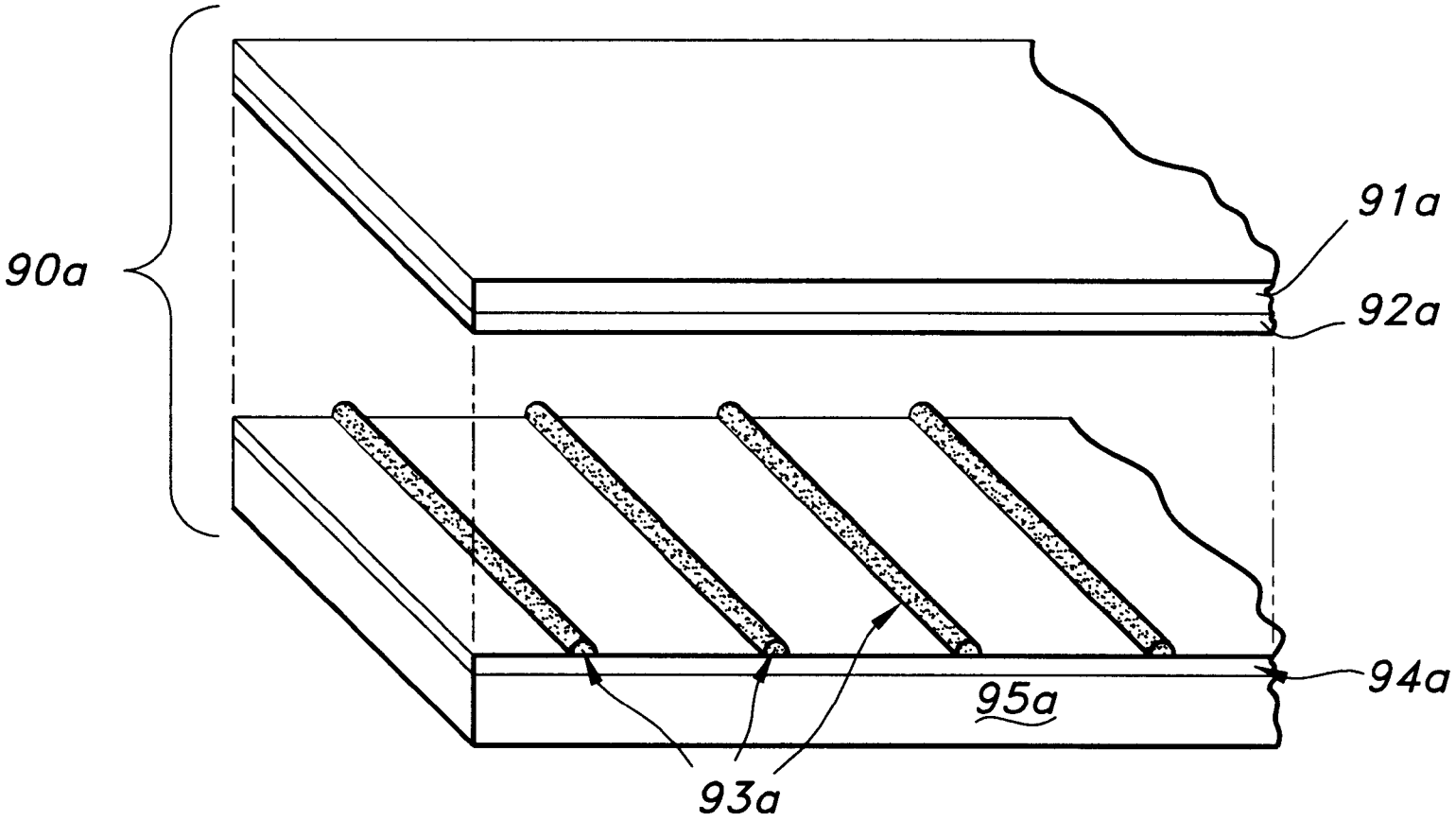
FIG. 4 is a perspective view of a switching device having a standoff configured in strips.

Referring now to FIG. 4, an alternative embodiment of the safety mat switching device is shown. Safety mat 90*a* includes a base 95*a* with lower electrode layer 94*a* attached thereto, and an insulative cover sheet 91*a* with upper electrode layer 92*a* attached thereto. The standoff comprises a plurality of spaced apart insulative polymeric foam strips 93*a* positioned between electrode layers 92*a* and 94*a*. The materials and dimensions of the base insulative cover sheet 91*a*, and electrode layers 92*a* and 94*a* can correspond to the respective components of the safety mat embodiment 90 described above. The insulative resilient polymer foam standoff 93*a* can be fabricated from the same material as described above with respect to dots 83*a* and 87*a*. Alternatively, a piezoresistive foam layer may optionally be incorporated into the safety mat switching device 90*a* and positioned between the standoff layer 93*a* and one or the other of electrode layers 92*a* and 94*a*. In yet another alternative, a combination of both strips 93*a* and dots 87*a* may be used as a standoff layer.

Figure 5:
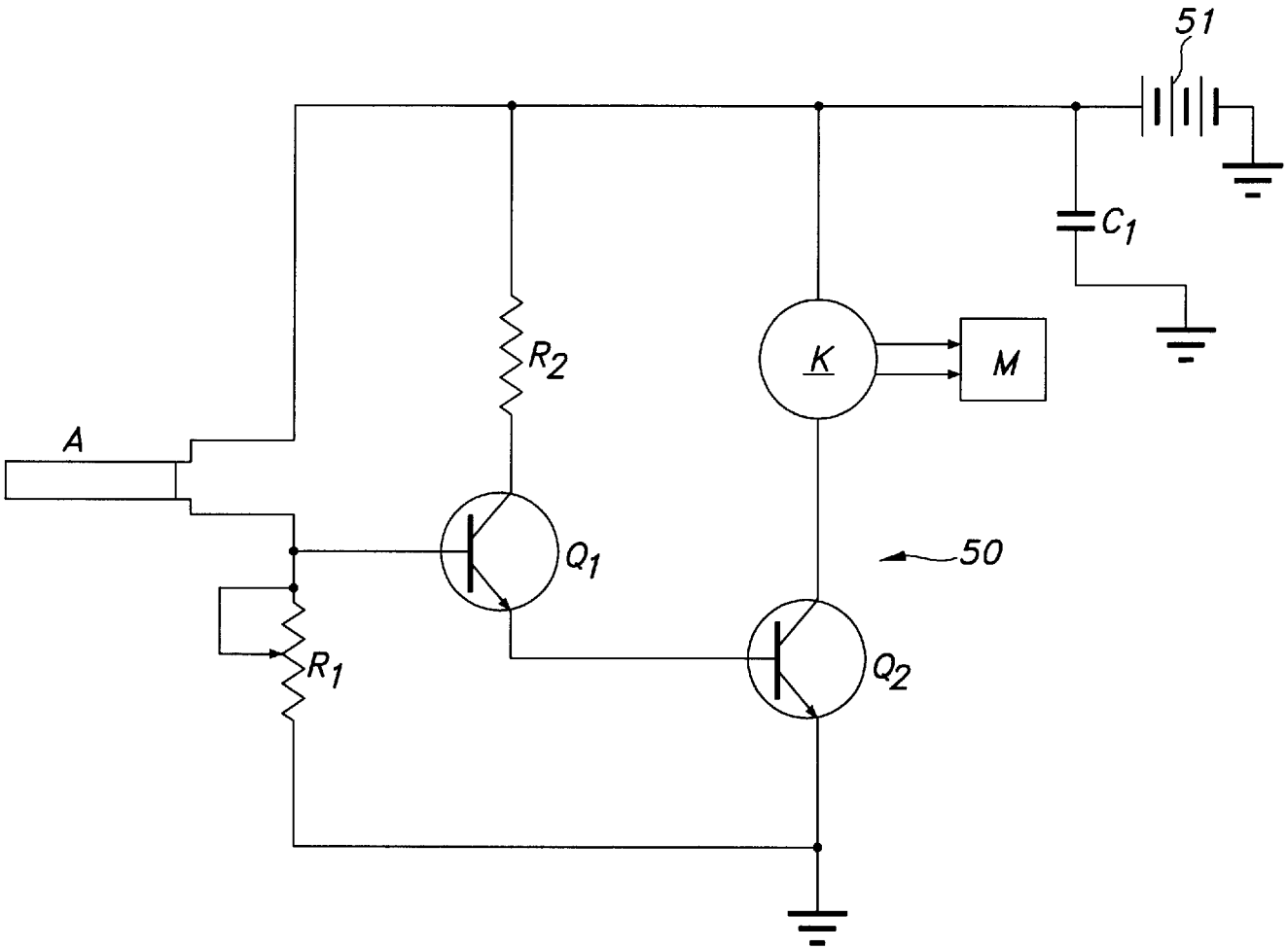
FIG. 5 is a diagram of an electric circuit for use with the apparatus of the present invention.

Referring now to FIG. 5, a circuit 50 is shown in which any of the mat switches of the present invention may be employed to operate a relay.

Circuit 50 is powered by a direct current source, i.e., battery 51, which provides a d.c. voltage $V_o$ ranging from about 12 to 48 volts, preferably 24 to 36 volts. The safety mat A can be any of the embodiments of the invention described above.

Potentiometer $R_1$ can range from 1,000 ohms to about 10,000 ohms and provides a calibration resistance. Resistor $R_2$ has a fixed resistance of from about 1,000 ohms to about 10,000 ohms. Transistors $Q_1$ and $Q_2$ provide amplification of the signal from the safety mat A in order to operate relay K. Relay K is used to close or open the electrical circuit on which the machinery M to be controlled operates. Capacitor $C_1$ ranges from between about 0.01 microfarads and 0.1 microfarads and is provided to suppress noise. K can be replaced with a metering device to measure force at A. This would require adjusting the ratio of $R_1$ and A (compression vs force) to bias transistors $Q_1$ and $Q_2$ into their linear amplifying range. This circuit represents an example of how the mat may be activated. Many other circuits including the use of triacs can be employed.

The present invention can be used in many applications other than safety mats for machinery. For example, the invention may be used for intrusion detection, cargo shift detection, crash dummies, athletic targets (e.g. baseball, karate, boxing, etc.), sensor devices on human limbs to provide computer intelligence for prosthesis control, feedback devices for virtual reality displays, mattress covers to monitor heat beat (especially for use in hospitals or for signalling stoppage of the heart from sudden infant death syndrome), toys, assisting devices for the blind, computer input devices, ship mooring aids, keyboards, analog button switches, "smart" gaskets, weighing scales, and the like.

It will be understood that various modifications may be made to the embodiments disclosed herein. Therefore, the above description should not be construed as limiting but merely as exemplifications of preferred embodiments. Those skilled in art will envision other modifications within the scope and spirit of the claims appended hereto.

What is claimed is:

1. A pressure actuated switching apparatus which comprises:

a) first and second conductive electrode layers, at least one of said first and second conductive electrode layers being movable in response to application of a mechanical force thereto from an open circuit first position to a second position wherein at least a portion of said first conductive electrode layer is in electrical contact with at least a portion of the second conductive electrode layer, each conductive electrode layer being electrically connected to a respective terminal of a power source for maintaining the first and second conductive electrode layers at different electrical potentials with respect to each other in at least the open circuit first position; and, b) a plurality of discrete, spaced apart dots positioned between said first and second conductive electrode layers, said dots being fabricated from an electrically insulative elastomeric polymer foam and resiliently biasing said first and second conductive electrode layers to the open circuit first position, wherein said dots possess a height of at least about 1/64 inch.

2. The pressure actuated switching apparatus of claim 1 wherein the density of the electrically insulative elastomeric foam when not compressed is from about 2 pounds per cubic foot to about 15 pounds per cubic foot.

3. The pressure actuated switching apparatus of claim 1 wherein the electrically insulative elastomeric foam is an open celled foam.

4. The pressure actuated switching apparatus of claim 1 wherein the electrically insulative elastomer is a closed cell foam.

5. The pressure actuated switching apparatus of claim 1 wherein said dots are fabricated from a material selected from the group consisting of silicone, polyurethane, polyvinyl chloride and natural and synthetic rubber.

6. The pressure actuated switching apparatus of claim 1 further comprising an electrically insulative cover sheet bonded to the first conductive electrode layer and an electrically insulative base bonded to the second conductive electrode layer.

7. The pressure actuated switching apparatus of claim 1 wherein said first and second conductive electrode layers each comprise a sheet of metal having a thickness of from about 0.001 inches to about 0.030 inches.

8. The pressure actuated switching apparatus of claim 1 wherein at least said first conductive electrode layer comprises a sheet of conductive elastomeric material.

9. The pressure actuated switching apparatus of claim 1 wherein each said dot is movable in response to pressure between an initial configuration having a first volume and a compressed configuration wherein the dot occupies a second volume which is less than 50% that of the first volume.

10. The pressure actuated switching apparatus of claim 1 wherein each said dot is movable in response to pressure between an initial configuration having a first volume and a compressed configuration wherein the dot occupies a second volume which is less than 20% that of the first volume.

11. The pressure actuated switching apparatus of claim 1 wherein each said dot is movable in response to pressure between an initial configuration having a first volume and a compressed configuration wherein the dot occupies a second volume which is less than 5% that of the first volume.

12. The pressure actuated switching apparatus of claim 1 wherein at least one of said first and second conductive electrode layers comprises a layer of metal selected from the group consisting of aluminum, copper, nickel, stainless steel, and conductive plastic film.

13. The pressure actuated switching device of claim 1 wherein the dots are arrayed in a regularized pattern.

14. The pressure actuated switching device of claim 1 wherein the dots are randomly arrayed.

15. A pressure actuated switching apparatus which comprises:

a) first and second conductive layers;

b) a plurality of discrete, spaced apart dots positioned between said first and second conductive layers, said dots being fabricated from an electrically insulative elastomeric polymer foam; and c) a layer of compressible piezoresistive material wherein said plurality of discrete spaced apart dots comprises a first layer of laterally spaced apart dots positioned between at least one of said first and second conductive layers and said compressible piezoresistive material.

16. A pressure actuated switching apparatus which comprises:

a) first and second conductive layers;

b) a plurality of discrete, spaced apart dots positioned between said first and second conductive layers, said dots being fabricated from an electrically insulative elastomeric polymer foam; and c) a layer of compressible piezoresistive material wherein said plurality of discrete spaced apart dots comprises a first layer of laterally spaced apart dots positioned between said first conductive layer and said piezoresistive material and a second layer of laterally spaced apart dots positioned between said second conductive layer and said compressible piezoresistive material.

17. A pressure actuated switching apparatus which comprises:

a) first and second conductive electrode layers, at least one of said first and second conductive electrode layers being movable in response to application of a mechanical force thereto from an open circuit first position to a second position wherein at least a portion of said first conductive electrode layer is in electrical contact with at least a portion of the second conductive electrode layer; each conductive electrode layer being electrically connected to a respective terminal of a power source for maintaining the first and second conductive electrode layers at different electrical potentials with respect to each other in at least the open circuit first position; and, b) a standoff including a plurality of discrete, spaced apart strips of electrically insulative elastomeric polymer foam positioned between said first and second conductive electrode layers and resiliently biasing said first and second conductive electrode layers to the open circuit first position, wherein said strips possess a height of at least about 1/64 inches.

18. The pressure actuated switching apparatus of claim 17 further comprising an insulative cover sheet bonded to the first conductive electrode layer and an electrically insulative base bonded to the second conductive electrode layer.

19. The pressure actuated switching apparatus of claim 17 wherein the electrically insulative elastomeric polymer foam is an open celled foam.

20. The pressure actuated switching apparatus of claim 17 wherein the electrically insulative elastomeric polymer foam is a closed cell foam.

21. The pressure actuated switching apparatus of claim 17 wherein each said strip is movable in response to pressure between an initial configuration having a first volume and a compressed configuration having a second volume which is less than 50% that of the first volume.

22. The pressure actuated switching apparatus of claim 17 wherein the standoff further includes a plurality of discrete, spaced apart dots of electrically insulative elastomeric polymer foam.

23. The pressure actuated switching device of claim 17 wherein the spaced apart strips of the standoff are parallel to each other and are positioned to define a single standoff layer in contact with both of the first and second conductive electrode layers.

24. A pressure actuated switching apparatus which comprises:

a) first and second conductive layers;

b) a standoff including a plurality of discrete, spaced apart strips of electrically insulative elastomeric polymer foam positioned between said first and second conductive layers; and, c) a layer of compressible piezoresistive material wherein said plurality of discrete spaced apart strips of electrically insulative elastomeric polymer foam comprises a first layer of laterally spaced apart foam strips positioned between the compressible piezoresistive material and at least one of the first and second conductive layers.

* * * * *